United States Patent [19]

Rockerath et al.

[11] Patent Number: 4,545,544

[45] Date of Patent: Oct. 8, 1985

[54] FABRIC HANDLING APPARATUS AND METHOD

[75] Inventors: John L. Rockerath, Voorhees; Dale K. Blust, Stratford, both of N.J.

[73] Assignee: Figge International, Inc., Richmond, Va.

[21] Appl. No.: 416,593

[22] Filed: Sep. 10, 1982

[51] Int. Cl.[4] ..... B65H 75/02; D05B 21/00

[52] U.S. Cl. ..... 242/55; 112/121.12; 112/121.26

[58] Field of Search ..... 242/75.2, 55, 55.1, 242/75.3; 226/107, 108, 115, 117, 168, 195; 112/121.12, 121.15, 121.24, 121.26

[56] References Cited

U.S. PATENT DOCUMENTS

| | | | |
|---|---|---|---|
| 1,716,375 | 6/1929 | Fowler | 226/108 |
| 2,189,059 | 2/1940 | Dearsley | 226/195 X |
| 2,277,514 | 3/1942 | Elser | 226/108 |
| 2,317,937 | 4/1943 | Plass | 34/157 X |
| 2,968,982 | 1/1961 | Cousino | 83/262 |
| 3,143,016 | 8/1964 | Obenshain | 83/98 |
| 3,216,296 | 11/1965 | Forrester | 83/88 |
| 3,368,771 | 2/1968 | Schmidt et al. | 242/75.2 |
| 3,533,320 | 11/1970 | Sederberg | 83/155 |
| 3,820,484 | 6/1974 | Neill et al. | 112/121.26 |
| 4,003,411 | 1/1977 | Hašek | 139/308 |
| 4,108,711 | 8/1978 | Hoffmann | 156/497 |
| 4,124,156 | 11/1978 | Waffner | 226/108 X |
| 4,182,208 | 1/1980 | Bruno | 83/118 |
| 4,189,965 | 2/1980 | Kollann | 83/155 |
| 4,244,504 | 1/1981 | Grob et al. | 226/117 X |
| 4,300,421 | 11/1981 | Yano et al. | 83/99 |

*Primary Examiner*—H. Hampton Hunter
*Attorney, Agent, or Firm*—Thomas A. Lennox

[57] ABSTRACT

A fabric handling device and method, particularly useful for light weight, nonwoven web material, including a fast feed roller device in substantial contact with the fabric surface continuously rotating faster than the fabric speed, with a coefficient of friction chosen to provide sliding friction but allow the roller surface to slide over the fabric surface, a positioning device including an air jetting below a horizontal surface element above the fabric, a dual edge cutting tool device that travels and cuts in both directions, and a pair of continuous belts sandwiching the fabric pieces against a table and moving the pieces to a subsequent work station.

18 Claims, 6 Drawing Figures

FABRIC HANDLING APPARATUS AND METHOD

BACKGROUND OF THE INVENTION

This invention relates to an apparatus and method for supplying a continuous feed of fabric material, handling the material, cutting the material into pieces and transporting the material to a subsequent work station.

By the term "fabric", as used throughout the specifications and the claims, it is intended that that term include both woven and nonwoven fabric, webbing material, film, such as plastic film, reinforced and unreinforced, such as polyethylene film, and sheet materials, all supplied in a continuous form.

This invention particularly relates to an apparatus and method for supplying nonwoven web fabric such as that used to produce caps as described in U.S. Pat. No. 3,820,484 to William M. Neill and George A. Burt, Jr. of June 28, 1974, incorporated herein by reference to illustrate the utility of the invention and to provide additional detail as to the apparatus and method of this invention.

A particular problem in continuous manufacturing operations utilizing pieces of fabric, is to handle the material from large rolls, which are an essentially inexhaustable source, cut the fabric into pieces and move them to a subsequent work station where later manufacturing steps are taken, such as that of the Neill patent described hereinabove.

In particular, the large rolls of fabric are extremely heavy, are not necessarily balanced or of even tension, and in any case vary substantially as to the pulling power necessary to pull the fabric off the roll as the amount of fabric remaining on the roll decreases. These large rolls have a tendency to be harder to get started rotating and then difficult to stop when the material is being pulled off on an intermittent basis. Thus, an uneven supply of the continuous fabric to a cutter is a problem that had not been solved.

In addition, certain types of fabric and in particular the nonwoven, lightly structured, almost diaphanous material used in the Neill patent is difficult to handle to maintain a smooth uniform positioning during the cutting process and later handling processing of the cut pieces. These problems as well as others illustrated later, constituted a great need to allow the developments of the Neill patent and like continuous processes to be fully developed into an operational production apparatus and method.

SUMMARY OF THE INVENTION

The invention includes a device for continuous supply of fabric including a supply device to provide a continuous supply of fabric material, such as a large roll of fabric from the manufacturer. A "nip roll" device, defined as including any device to intermittently pull the material from the supply at a certain rate of speed and including but not limited to using standard nip rolls as the operative device. A fast feed roller device is interposed between the supply and the nip roll device, including at least two continuously rotating feed rollers, each roller rotating with the flow of the material. Preferably, there are two rollers rotating in opposite directions. The rollers are positioned to be in pressure contact with the surface of the fabric such that the surface area of contact with the fabric is of a surface area greater than 180 degrees of the combined radial surface on the rollers. Preferably two rollers are each in contact with greater than 90 degrees of their radial surface area. The feed rollers are operated at a rotating speed faster than the nip roll device pulling speed, and have a coefficient of friction between the roll surface and the fabric material to allow the roller to slide over the surface of the fabric. The coefficient is preferably low.

A particular embodiment of the apparatus includes an intermittent second feed roller, positioned to contact the fabric after it leaves the fast feed roller device. The second feed roller rotates at the time interval and concurrently with the nip roll device with the flow of material. The contact between the roller and the material has a surface area greater than about 90 percent of the roller's radial surface, with a coefficient of friction between this roller and the fabric to allow the roller to slide over the fabric. Preferably, the rotational speed of this second feed roller is faster than the nip roll, but less than that of the fast feed roller device. The preferred range of speeds is that the fast feed roller device rotate at about 50 percent or more faster than the nip roll, and more preferably about 50 to about 200 percent faster. Similarly, the second feed roller is preferably rotated at about 10 to about 50 percent faster than the nip roll.

A particular embodiment includes a table surface positioned to receive the material from the nip roll device and a horizontal surface bar element device providing a horizontal surface above the table over the flow position of the fabric. An air jet device providing concentrated air jetting above the material in a general horizontal direction immediately below the horizontal surface, provides in combination a positioning device to cause the fabric to extend on to and spread upon the table surface in an even fashion.

A particular embodiment includes a slot in the table's surface transverse to the flow of fabric along the table surface and a clamping device to hold the material on both sides of the slot against the table surface. A cutting device includes a blade with two vertical cutting edges facing in opposite directions, extending through the slot of the plane of the table top surface, preferably in a downwardly direction. A blade traveling device is provided to hold the blade and to propel it along the slot to effect a cut of the fabric from one edge to the other edge to cut off a piece of material. The blade traveling device also propels the cutting blade back along the slot to effect the succeeding cut for the next piece of fabric, with each cut using only one of the two vertical cutting edges.

A particular embodiment includes a pair of continuous belts located above the fabric and positioned along the edges of the fabric along the flow line of the fabric on the table surface. A horizontal length of belt surface is positioned parallel with the table surface, equipped with a drive device to intermittently upon demand move that horizontal length of belt surface to the table surface to hold the fabric against the surface. A second drive device is provided to move the belts while in contact with the fabric along the table surface.

It is an object of this invention to provide a method and an apparatus with the capability of drawing fabric from a continuous source in such a fashion to provide to nip rolls, a uniform supply, despite the varying force required to draw on the continuous supply.

An additional object of this invention is to provide a take off system from a continuous roll of fabric that does not impart substantial stretching and stress to the fabric which might cause failure or distortion of the fabric structure.

It is a further object of this invention to provide a take off device to remove light weight fragile webs from large rolls without stretching or destroying the webs and supplying the material on a continuous and standardized condition.

It is a further object of this invention to provide a method and apparatus which will position and move the fabric past the nip rolls, causing it to spread evenly and uniformly over a transport table surface.

It is a particular object of this invention to control and position the light weight, nonwoven web used in cap making without having it become folded, bunched or stretched prior to the cutting process.

It is a further object of this invention to provide a cutting apparatus that allows slitting the fabric but does not cause a net movement of the fabric in the direction of the cut.

It is an additional object of this invention to provide a cutting device that reduces the need to replace blades or sharpen edges of the cutting blades.

It is an additional object of this invention to provide a device for handling the fabric pieces after they have been cut from the continuous supply, allowing these piece to be moved to the next work station while keeping the fabric flat and completely under control of the handling device.

It is a particular object of this invention to handle the light weight, airy, nonwoven webs used in cap making, holding them in a fashion to prevent any possible movement out of alignment as they are moved to the next work station.

It is a particular object of this invention to provide an improved supply and handling apparatus and method to deliver fabric pieces, one after the other, to an attaching apparatus as described in the Neill patent incorporated herein by reference.

DESCRIPTION OF PREFERRED EMBODIMENTS

Figure 1:
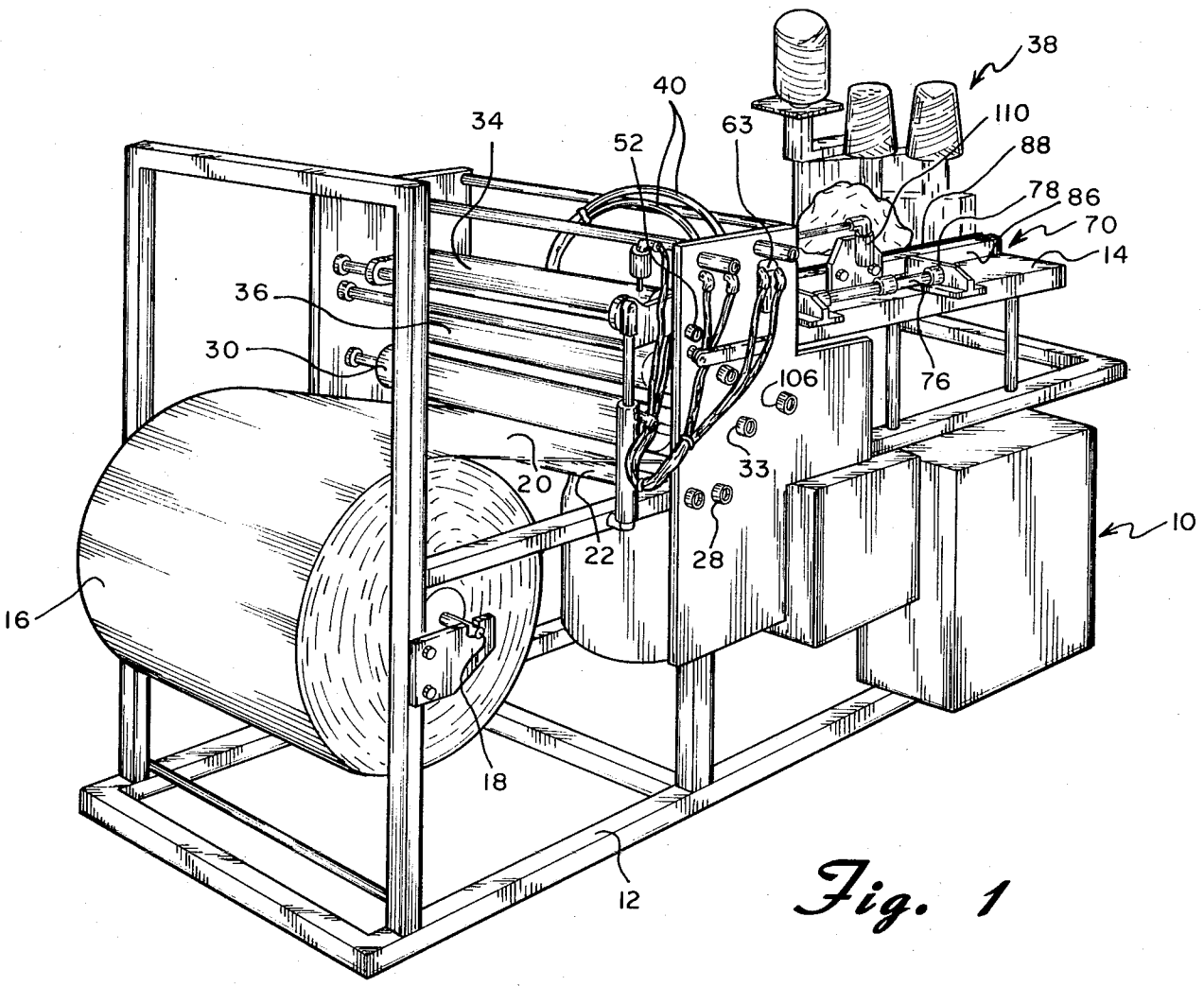
FIG. 1 is a perspective view of the material handling device of this invention, supplying fabric pieces to a cap making apparatus.

Preferred embodiments of the invention include all the following and in particular include a tension bar device placed in contact with the fabric in the flow before the fast feed roller device in position to cause the fabric to pass against the bar and provide tension against the fabric generally in the form of a vertical force moment. A power device is provided to provide rotation of the various rollers at the relative speeds and at the required time intervals. The supply device is generally a large supply roll of a continuous length of fabric to supply material to two rubber nip rolls, equipped to intermittently pull the material at a chosen rate of speed. The tension bar device is preferably positioned to cause the web of fabric to pass over the top of a bar having a low sliding coefficient of friction with the fabric and providing an upwardly vertical force on the fabric. If additional tension is required, a pair of tension bars may be utilized wherein the fabric is passed over one and under the other to provide substantially increased surface area of sliding friction to increase the tension. The fast roller device preferably includes a first fast feed roller continuously rotating counterclockwise, positioned above the fabric in a position to provide surface contact with the fabric. A second fast feed roller is continuously rotating clockwise, positioned below the surface of the fabric, such that the fabric is in contact with a substantial portion of its surface. In each case, the surface contact should be with at least 90 degrees of the radial surface area of the roller. The preferred diameter of the feed rollers being at least two inches, up to about ten inches in diameter, more preferably about three to four inches in diameter. The coefficient of friction between the fabric and the fast feed roller device is not as critical when the nip roller means is not pulling the material, but is considerably more important when the nip roll device is pulling the material through the fast feed roller device.

The supply device described above is particularly effective in combination with various additional handling devices, including a cutting device to slice the fabric into pieces, and a piece transfer device to advance the fabric pieces, one after the other, to an operational device to effect a further manufacturing step to the fabric piece. This operational device includes the cap making device described above generally described as an apparatus for forming a cap, including advancing the fabric pieces one after the other to an attaching device, a device for rotating the fabric piece about an axis through a central portion of the piece, a device for gripping the central portion of the fabric piece, and a device operative simultaneously and in timed relation to the rotating device, to attach a stretch elastic material to the fabric piece in a predetermined closed curved about the axis of rotation. A trimming device is included positioned radially outward of the attaching means and operative in timed relation thereto for removing excess material from the fabric piece.

In the fabric positioning device, it is preferred that the air jetting be directed slightly upwardly at an angle toward the horizontal surface. This straightening device coupled with a cutting device and a piece handling device to advance the fabric pieces one after another form a particularly useful combination, and is particularly effective with the cap making device described above. The horizontal surface element is preferably a hold-down bar element positioned above the fabric, connected to a clamping means to cause the horizontal surface bar to descend holding the fabric against the table surface, where it may be cut into pieces. The blade traveling device for the cutting device is preferably a cutting blade attached to a holder element, sliding on a horizontal rod, first in one direction to cut off one piece of fabric, and then in the opposite direction back to the starting place, cutting off a second piece of fabric, preferably powered by pneumatic equipment. The horizontal lengths of the belts of the fabric piece supply device are preferably each angled slightly away from the parallel relationship with each other. In that fashion, as the belts move carrying the fabric along the table surface, the fabric is slightly stretched. The surface of the belts in contact with the fabric have a high coefficient of friction with the fabric as compared to the coefficient of friction between the surface of the fabric and the table surface.

The methods of this invention include pulling on an intermittent basis upon demand from an essentially continuous supply of fabric material, and imposing between the supply source of the fabric and the device accomplishing the pulling, a fast feed roller device including at least two continuously rotating feed rollers, each roller rotating with the flow of the material, the rollers positioned to pressure contact the fabric on a surface area greater than 180 degrees of the combined radial surface of the rollers. The feed rollers are operated at a rotating speed faster than the speed of pulling and have a coefficient of friction between the roll surface and the fabric material to allow the roller to slide over the fabric surface. The method includes dispensing the fabric on a table surface device, positioned to receive the material and placing a horizontal surface bar element device which provides a horizontal surface above the table over the flow position of the fabric, and directing an air jet providing concentrated air jetting above the fabric material in a generally horizontal direction below the horizontal surface. The method also may include clamping the material on both sides of a slot in the table surface, cutting the material along the slot in the table, positioning a pair of continuous belts above the table along the edges of the fabric, along the flow line of the fabric on the table surface, with a horizontal length of belt surface parallel to the table surface, moving the belts intermittently upon demand to the table surface to hold the fabric, and driving the belts while in contact with the fabric to carry the fabric along the table surface.

Figure 2:
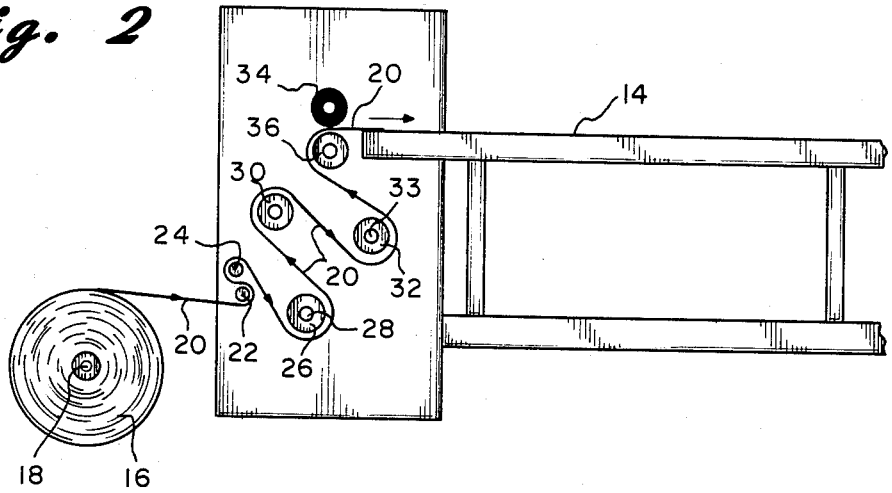
FIG. 2 is a schematic view of the material take off device of this invention, supplying continuous material to the table top.

Referring now to FIG. 1, cap making device 10 is illustrated as generally embodying the characteristics of the cap making apparatus and method described in the Neill patent referred to above. The device is constructed on frame 12 all essentially settling around and directed to table top surface 14. Continuous light weight webbing is drawn from supply roll 16, rotating on rod 18. Webbing 20 is first drawn under tension bar 22 around and over up to second tension bar 24, around it and downwardly to first fast feed roller 26, partially hidden in FIG. 1, rotating on rod 28. In this area, it is useful to refer to the schematic drawing of FIG. 2 showing the flow of webbing material through this feed apparatus, under roller 26, around it to return at about a 200 degree angle to second fast feed roller 30, passing underneath the roller around over the top and returning backwardly toward the feed angle at more than a 180 degree angle. Tension bars 22 and 23 are constructed of one and one-half inch diameter polished stainless steel, allowing the webbing to slide over and around the bars, maintaining a tension on the fabric. These bars may be adjusted as to position and tension to balance the tension against the webbing pull off without increasing the force required to the point of damaging the webbing. Bar 22 may be left off stream as a preferred embodiment.

Rollers 26 and 30 are each four inch polished stainless steel rollers, each rotating at a radial speed approximately twice that of the speed of take off from roll 16. Roller 26 is positioned in reference to the other rollers such that there is more than 180 degrees of the roller radial surface in contact with the webbing as the roller rotates counterclockwise. Roller 30 is essentially identical to that roller 26, except that it rotates at approximately the same speed in a clockwise fashion, and it is also positioned to be in contact with the webbing over more than 180 degrees of its radial surface. It is preferred that the surface contact between rollers 26 and 30 be more than 90 degrees of the radial surface, more preferably 90 to about 225 degrees of its radial surface, and more preferably 100 to 200 degrees of its radial surface. As can be imagined, the positioning of these rollers may be such that surface contact may be substantially different and the preferred embodiments may be considered as a total of the surface contact area of the two rollers, preferably being greater than about 180 degrees, more preferably about 180 to about 450 degrees and most preferably 300 degrees to 400 degrees of their combined radial surface areas.

After webbing 20 passes around roller 30, it is directed under, around and over roller 32, which is essentially identical to rollers 26 and 30 as far as construction is concerned. However, feed roller 32 rotates on rod 33 only with and at the same time as material is drawn from roll 16 by nip rolls 34 and 36. The rotational speed of roll 32 is preferably slightly faster than that of the actual speed of the web movement, and thus of the radial speed of the nip rollers 34 and 36. It is preferred that the speed of roller 32 be 10 to 50 percent faster than the actual speed of the moving web. Standard rubber nip rollers 34 and 36 are of standard design, squeezing webbing 20 and drawing the webbing through the rollers upon demand, and depositing the webbing on the table top surface 14. Feed roller 32 is positioned such that webbing 20 is in contact with greater than 180 degrees of the radial surface of the roller and the preferences for contact surface are essentially identical with that of the preferences for rollers 26 and 30. As webbing 20 is drawn between nip rollers 34 and 36, it is pulled taut against rollers 26, 30 and 32. Rollers 26 and 30 are continuously operated at a higher rate of speed than the flow of the webbing, even when the nip rolls are operating at full speed. The fabric slides over the surface of rollers 26 and 30 at a speed relative to the surface of the rollers, essentially equal to its actual surface speed. Webbing 20 is pulled taut over now rotating roller 32, which is preferably rotating at a slightly higher speed than the speed of the fabric, causing it to slide slightly over the surface of roller 32.

Figure 3:
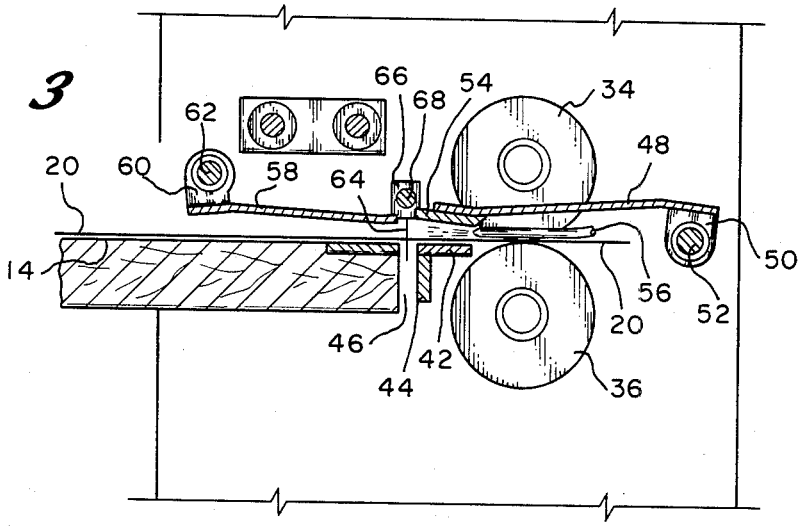
FIG. 3 is a schematic, partial cross-sectional view of the cutting and positioning apparatus of this invention in the open position to receive the fabric.
Figure 4:
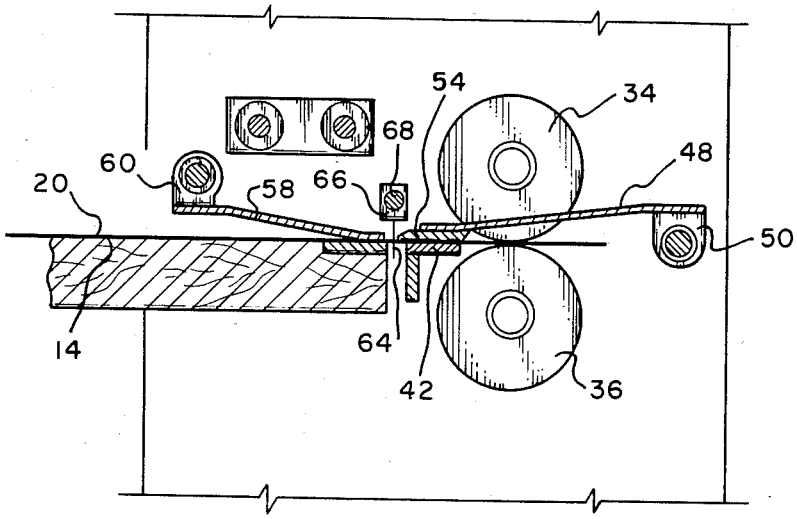
FIG. 4 is identical to that of FIG. 3 except that the fabric has been clamped in place for cutting.
Figure 5:
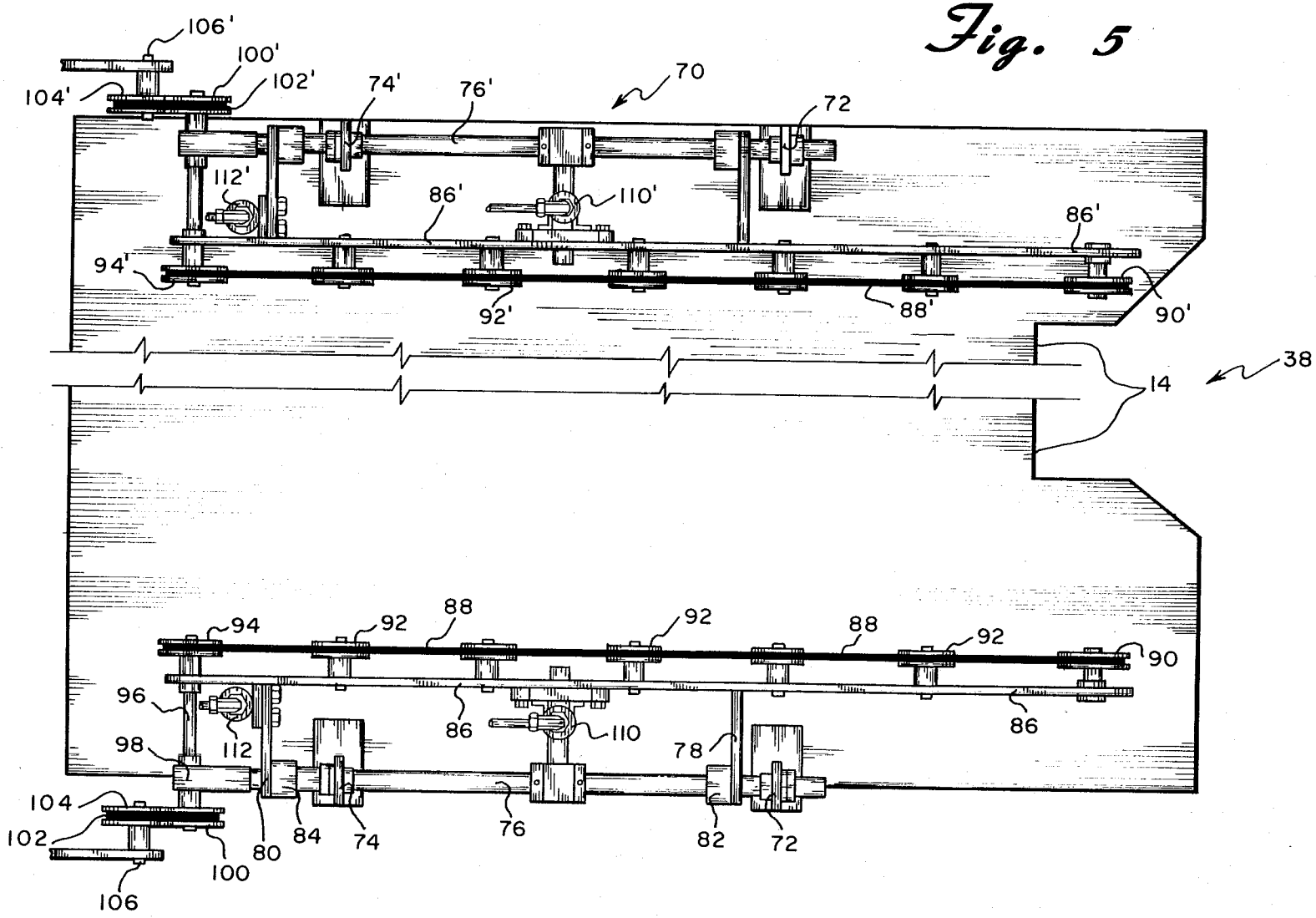
FIG. 5 is a top view of the fabric piece handling device of this invention, looking downwardly to the table top.
Figure 6:
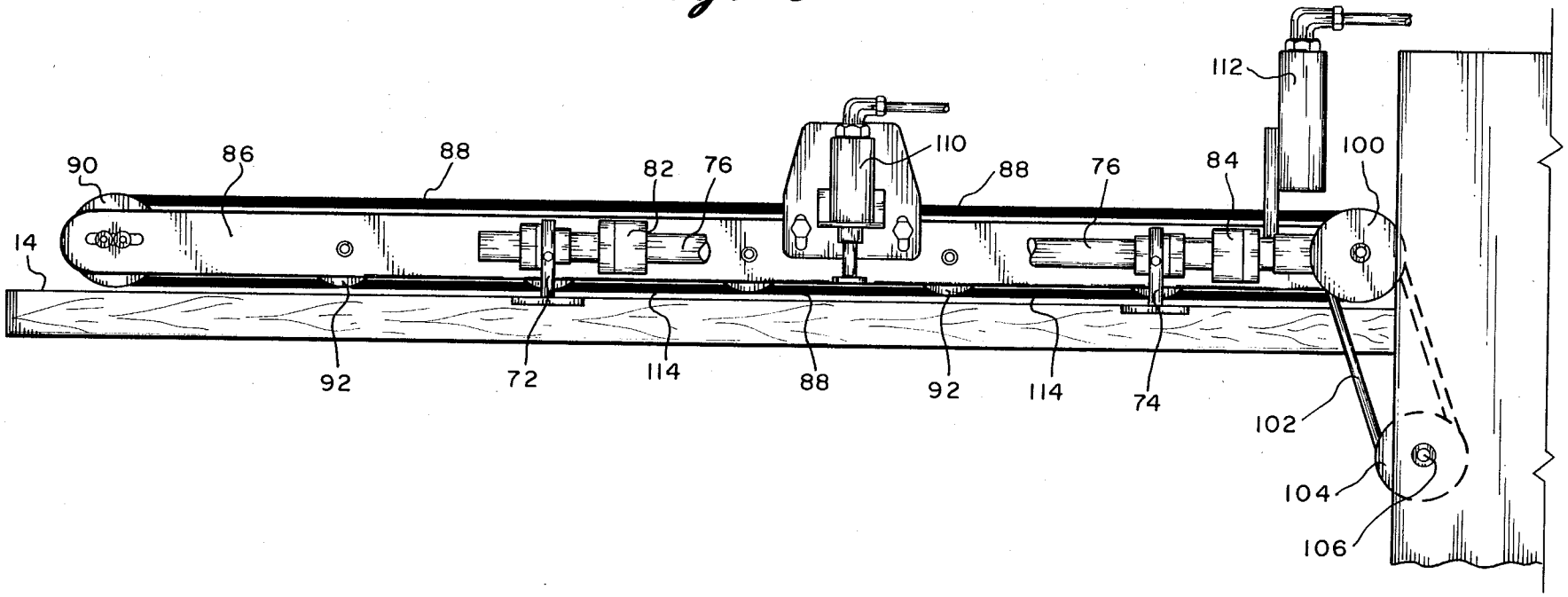
FIG. 6 is a side view of the fabric piece handling device of this invention.

Returning now to FIG. 1, cap sewing apparatus 38 is constructed to operate above table surface 14 on which webbing 20 is deposited from standard rubber nip rolls 34 and 36. Most of the movement of the various parts other than rotation is by pneumatic pressure, operated through tubes 40 connected to the various elements. Referring also to FIG. 3, webbing 20 is deposited on front lip 42, supported on bracket 44 to form slot 46 in front of table surface 14. Webbing 20 passes under hold-down arm 48, welded to bracket 50, firmly attached on rod 52 which is twisted by pneumatic cylinder 51 to move arm 48 vertically. Positioned on the free end of rod 48 is horizontal surface plate 54 held in a generally horizontal plane above table surface 14. Although not pictured, air jet 56 positioned to jet air directly under the bottom horizontal surface of plate 54 is angled slightly upwardly toward that plate surface. Preferably, the jetting is directed upwardly about one to five degrees. Rear hold-down arm 58 is attached to bracket 60, rotating by rod 62, powered by pneumatic cylinder 63. Both arms 48 and 58 are operated pneumatically and as illustrated in FIG. 4, are capable of rotating downwardly to trap webbing 20 against surface 14 and the top surface of front lip 42. With hold-down member 58 and horizontal plate 54 holding the webbing in place, knife blade 64 held in bracket 66 rides on rod 68. Bracket 66 is powered by a pneumatic line and is essentially shot from one side of the fabric to the other, cutting as it passes one fabric piece off. Knife blade 64 is a "V" shaped knife blade having cutting edges on both sides, each at an angle from the vertical of about 30 to 45 degrees, positioned such that the cutting blade bisects the planar surface of table 14 and lip 42. After blade 64 passes one direction, it stays in that position until a second fabric piece is in position to be cut. Bracket 66 is shot back across slot 46 to cut the succeeding fabric piece and returns to its initial position. Although movement of the fabric while in the clamped position is only slight with one pass, cummulative passes in the same direction ultimately force the fabric toward one side of the table. Return cutting in opposite directions as described above eliminates that problem. The top view of the fabric piece handling mechanism 70 is illustrated in a top view in FIG. 5, looking down on table top surface 14. The mechanisms on opposite sides of table 14 are essentially mirror images of each other and for the purposes of simplicity, only one side will be described, the other side being designated with a "prime". It should be recognized that essentially identical parts are positioned across from the described parts to form the dual structure, handling the fabric pieces along their outside edges along the flow pattern of the process. Brackets 72 and 74 attach to table surface 14 and rigidly hold rod 66 in a horizontal position. Arms 78 and 80 fixed to bushings 82 and 84 rotate on rod 66. Arms 78 and 80 rigidly support and hold horizontal pulley holding member 86 in a horizontal position above table surface 14. Belt 88 rides on main follower pulley 90 and minor follower pulley 92, driven by drive pulley 94. Drive pulley 94 is driven by rod 96, passing through bushings in member 86 and extension 98 of rod 76 to upper belt drive pulley 100, driven by belt 102 by lower belt drive pulley 104 turning on rod 106. Although it may not be apparent from FIG. 5, belts 88 and 88' diverge slightly in the horizontal direction as they approach work station 38, the sewing apparatus. Belts 88 and 88' diverge approximately one degree from parallel arrangement and preferably diverge about $\frac{1}{2}$ to about five degrees from parallel arrangement. Pneumatic cylinders 110 and 112 operate to lift holding member 86, rotating on rod 76 to both lift belt 88 from table surface 14 and to, later in the work cycle, press bottom horizontal belt surface 114 against table surface 14, trapping fabric pieces between the two surfaces and allow them to be moved horizontally along surface 14 to sewing apparatus 38. This bottom surface 114 is best illustrated in the side view of FIG. 6.

While this invention has been described with reference to the specific embodiments disclosed herein, it is not confined to the details set forth and the patent is intended to include modifications and changes which may come within and extend from the following claims.

We claim:

1. A device for continuous supply of fabric comprising:

(a) a supply means to provide a continuous supply of fabric material, (b) nip roll means to intermittently pull the material at a certain rate of speed, and (c) a fast feed roller means comprising at least two continuously rotating feed rollers, each roller rotating with the flow of the material, the rollers positioned to pressure contact the fabric on a surface area greater than about 180 degrees of the combined radial surface on the rollers, wherein the feed rollers are operated at a rotating speed faster than the nip roll means pulling speed and have a coefficient of friction between the roll surface and the material to allow the rollers to slide over the fabric.

2. The device of claim 1 wherein a tension bar means is included in contact with the fabric in the flow before the fast feed roller means in position to cause the fabric to pass against the bar and provide a tension force moment against the fabric.

3. The device of claim 1 wherein an intermittent second feed roller is included in position against the fabric after it leaves the fast feed roller means, the second feed roller rotating at the same time interval as the nip roll means with flow of material having surface contact with this roller greater than 90 degrees of its radial surface, a low coefficient of friction between the second feed roller and the fabric to allow the roller to slide over the fabric and with a rotational speed faster than the nip roll speed but less that that of the fast feed roller means.

4. The device of claim 1 wherein the fast roller means comprises 2 rollers rotating in opposite directions.

5. The device of claim 1 wherein the supply means is a large supply roll of a continuous length of fabric to supply material to the nip rolls equipped to intermittently pull the material at a certain rate of speed.

6. The device of claim 2 wherein the tension bar means is positioned to cause the fabric to pass over the top of a bar having a low sliding coefficient of friction and providing an upwardly vertical force on the fabric.

7. The device of claim 1 wherein the fast feed roller means comprises a first fast feed roller continuously rotating counterclockwise positioned above the fabric in a position to provide surface contact with at least 90 degrees to about 225 degrees of its radial surface area and a second fast feed roller continuously rotating clockwise positioned below the surface of the fabric such that the fabric is in contact with at least 90 degrees to about 225 degrees of the radial surface area of the second roller.

8. The device of claim 7 wherein the surface contact of each roller with the fabric is in the range of about 150 degrees to about 200 degrees of the radial surface area of the roller.

9. The device of claim 1 wherein the fast feed roller means is positioned to effect surface contact with the fabric in a surface area in the range of 180 degrees to about 450 degrees of the combined radial surface area of the rollers.

10. The device of claim 9 wherein the combined radial surface area of contact between the fast feed roller means and the fabric is in the range of about 300 degrees to 400 degrees of the surface area of the rollers.

11. The device of claim 1 wherein the rotational speed of the fast feed roller means is about 50% to about 200% faster than the speed of the nip rolls when rotating.

12. The device of claim 1 wherein the coefficient of friction between the fabric and the fast feed roller means is low not only when the nip roll means is not pulling the material, but also when the nip roll means is pulling the material from the supply means.

13. The device of claim 3 wherein the second feed roller is positioned above the fabric in surface contact with the fabric greater than 90 degrees of the radial surface of the roller.

14. The device of claim 3 wherein the surface contact between the second feed roller and the fabric is in the range of about 150 degrees to 200 degrees of the radial surface area of the roller.

15. The device of claim 3 wherein the rotational speed of the second feed roller is faster than that of the nip roll speed in the range of about 10 percent to about 50 percent, but is less than the rotational speed of the fast feed roller means.

16. A device for continuously supplying fabric comprising (a) a supply roll means to provide a continuous supply length of fabric, (b) nip roll means equipped to intermittently pull the material at a certain rate of speed, (c) a tension bar means in contact with the surface of the fabric providing tension against the fabric, (d) a fast feed roller means comprising a first fast feed roller continuously rotating at a speed faster than the rate of the nip rolls, positioned to contact a surface of the fabric over an area in the range of about 150 degrees to 200 degrees of the radial surface area of the roller, with a low coefficient of friction between the fabric and the roller surface, and (i) a second fast feed roller continuously rotating in a direction opposite to that of the first feed roller, positioned to be in surface contact with the opposite surface of the fabric in the range of about 150 degrees to 200 degrees of the radial surface area of the roller at a rate of speed faster than that of the nip roll means, with a low coefficient of friction between the surface of the roller and the fabric, (e) an intermittent feed roller means comprising a roller rotating concurrently in time with the nip roll means and with the flow of material, positioned in contact with the fabric over an area greater than that of 90 degrees of the radial surface area of the roller, having a low coefficient of friction between the roller and the fabric under tension and rotating at a speed faster that the nip rolls, but less than that of the fast feed roller means, and (f) power means to supply rotational power at relative speeds and upon demand.

17. A method of supplying a continuous length of fabric comprising:

(a) pulling on an intermittent basis upon demand from an essentially continuous supply of fabric material, (b) interposing between the supply source of the fabric and the device accomplishing the pulling; a fast feed roller means comprising at least two continually rotating feed rollers, each roller rotating with the flow of the material, the rollers positioned to pressure contact the fabric on a surface area greater than 180 degrees of the combined radial surface of the rollers, wherein the feed rollers are operated at a rotating speed faster than the nip roll pulling speed, and have a low coefficient of friction between the roll surface of the material to allow the rollers to slide over the fabric surface.

18. The method of claim 17 wherein a tension bar means is interposed against the fabric flow before the pair of fast feed rollers to provide a tension force against the fabric.

* * * * *

UNITED STATES PATENT AND TRADEMARK OFFICE

CERTIFICATE OF CORRECTION

PATENT NO. : 4,545,544

DATED : October 8, 1985

INVENTOR(S) : John L. Rockerath and Dale K. Blust

It is certified that error appears in the above-identified patent and that said Letters Patent is hereby corrected as shown below:

ON TITLE PAGE, CODE [73]

Assignee; delete "Figge International, Inc."

and insert --Figgie International Inc.--

Signed and Sealed this

*Fourteenth* Day of *January 1986*

[SEAL]

*Attest:*

DONALD J. QUIGG

*Attesting Officer*

*Commissioner of Patents and Trademarks*